United States Patent [19]

Skaalen et al.

[11] 4,335,670

[45] Jun. 22, 1982

[54] FLEXIBLE SIDE CONNECTOR FOR FLOATING AND ELEVATED PLATFORMS

[75] Inventors: Clifford I. Skaalen, Oxnard; Arthur B. Rausch, Port Hueneme, both of Calif.

[73] Assignee: The United States of America as represented by the Secretary of the Navy, Washington, D.C.

[21] Appl. No.: 168,974

[22] Filed: Jul. 14, 1980

[51] Int. Cl.[3] ..... B63B 21/56

[52] U.S. Cl. ..... 114/249

[58] Field of Search ..... 114/242, 247–251, 114/264; 244/161; 280/483, 486

[56] References Cited

U.S. PATENT DOCUMENTS

| | | | |
|---|---|---|---|
| 2,684,653 | 7/1954 | Dyer | 114/251 |
| 3,344,487 | 10/1967 | Doutt | 114/249 |
| 3,345,970 | 10/1967 | DeLong | 114/248 |
| 3,799,100 | 3/1974 | Marriner | 114/249 |
| 4,080,921 | 3/1978 | Freitag | 114/249 |
| 4,276,850 | 7/1981 | Valencia | 114/249 |

*Primary Examiner*—Edward R. Kazenske
*Assistant Examiner*—Thomas J. Brahan
*Attorney, Agent, or Firm*—Robert F. Beers; Joseph M. St. Amand

[57] ABSTRACT

A flexible side connector assembly comprising an in line flexural system having a plurality of rubber compression elements and a solid shear member. Both the adjacently aligned flexural member and the shear member have grooved solid heads at opposing ends of the assembly for insert of guillotines in opposing platforms which are to be coupled each to the other.

16 Claims, 6 Drawing Figures

FLEXIBLE SIDE CONNECTOR FOR FLOATING AND ELEVATED PLATFORMS

BACKGROUND OF THE INVENTION

The present invention relates to coupling apparatus and more particularly to a flexible side connector for securing together floating platforms.

Naval pontoon causeway sections are normally end connected to form a roadway either floating or elevated on pipe pile from a beach through or over the surf zone. Requirements for wider platforms with greater work areas stipulate that standard pontoon causeway sections be side connected to obtain desired greater platform width. Several types of side connectors have been utilized in the past including mechanical and hydraulic actuated rigid connectors of various structural configurations. These rigid connectors have been limited in flexibility, structural capacity and have been difficult to utilize in an open sea environment where platform relative motions are involved.

Prior art connectors that are purely rigid or purely flexural or have a central resilient portion with opposing rigid end caps are not satisfactory for use in connecting pontoon causeway sections to provide the desired integrity and flexibility required.

The flexible side connectors disclosed herein have both structural and functional advantages over previously developed side connector schemes.

The flexible side connectors of this invention provide for side connecting floating and/or elevated platforms side by side resulting in greater working areas on such platforms. The flexible side connectors provide complete structural integrity and flexibility between platforms, and can be connected or disconnected when the platforms are moving relative to one another in the floating mode or after the platforms are elevated on pipe pile.

SUMMARY OF THE INVENTION

The present invention comprises a flexible side connector assembly comprising an in line flexural system having a plurality of rubber compression elements and a solid shear member. Both the adjacently aligned flexural member and the shear member have grooved solid heads at opposing ends of the assembly for insert of guillotines in opposing platforms which are to be coupled together.

The combination of flexibility are rigidity, as found in the instant invention, allows connected platforms to roll with respect to each other. Translation freedom in the vertical, lateral and longitudinal direction is prohibited. Roll around the longitudinal axis of the platforms is allowed or accommodated for. Roll around the lateral and vertical axis of the platforms is prohibited by the fact that two connectors, located toward opposite ends of the abutting sides of two platforms being connected together, form a resisting moment equal to the translational resistance times the distance between each connector.

The flexible side connector incorporates a large steel shear member which transmits the vertical shear loads from one platform to the other allowing the joint between platforms to be elevated from the water with jacks mounted on only one side of the joint. This is a distinct advantage when elevating platforms on pipe pile during pier construction. The flexible side connectors incorporate flexural rubber elements which allow relative rotation between platforms in the floating mode. Flexibility between sections in the floating mode allows each section to roll independently with wave motion reducing considerably the side connection forces between platforms when compared to a rigid connection between platforms causing the platforms to behave as a single unit. The flexibility of the male connector flexural assembly and the bell shape of the female connector allows for considerable relative motion between platforms across the connectable joint. Also, the sloped surface of the male steel shear member allows the connector to be mechanically pulled or hydraulically pushed into final position for locking.

DESCRIPTION OF THE PREFERRED EMBODIMENT

Figure 1A:
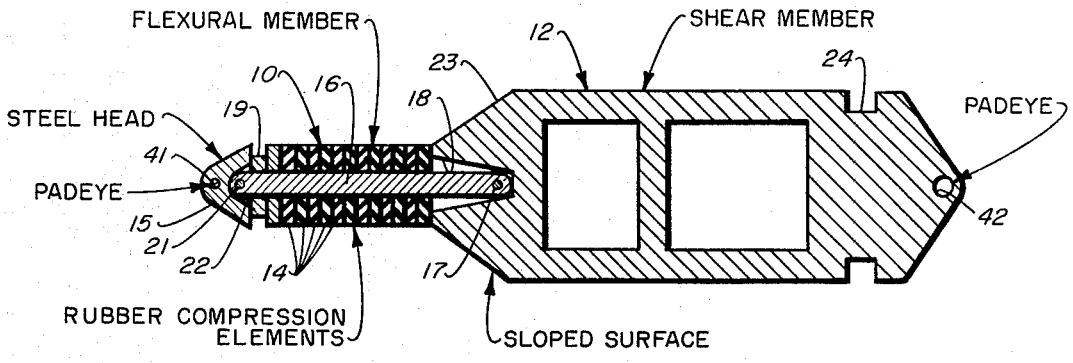
FIG. 1*a* shows a longitudinal cross-sectional view of the flexible side connector male assembly.
Figure 1B:
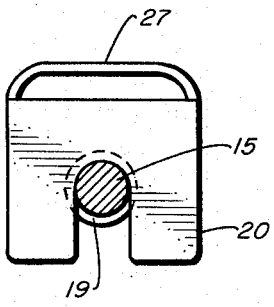
FIG. 1*b* and 1*c* show guillotine locking mechanisms for the flexible side connector.
Figure 1C:
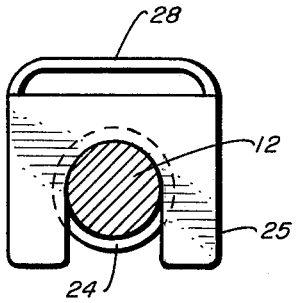

Structurally, the flexible side connector male assembly, as shown in FIG. 1*a*, comprises one flexural rubber member 10 and a solid steel shear member 12. The flexural member 10 consists of rubber compression elements 14, a solid steel head 15 and a steel rod tensile element 16. The steel rod tensile element 16 is connected at one end by a pin 17 or other suitable means within a truncated cone shaped opening 18 in shear member 12 which allows rod 16 a few degrees of angular movement where connected to shear member 12. The solid steel head 15 is grooved at 19 for a guillotine locking mechanism 20, as shown in FIG. 1*b*. The other end of tensile element 16 is connected by a pin 21 or other suitable means within a truncated cone shaped opening 22 in steel head 15, as shown in FIG. 1*a*, also allowing rod 16 a few degrees of angular movement within steel head 15. The solid steel shear member 12 has a sloped surface 23 for ease of installation and a mid depth as required to transmit shear load from one platform to the other. The solid steel shear member 12 is also provided with a groove at 24 for a guillotine locking mechanism 25, as shown in FIG. 1*c*. Handles 27 and 28 may be provided on guillotine locking mechanisms 20 and 25, respectively, if desired for ease in handling. A side connector female assembly, which is in a floating platform, is shown in FIG. 2 with a male connector installed.

Figure 3:
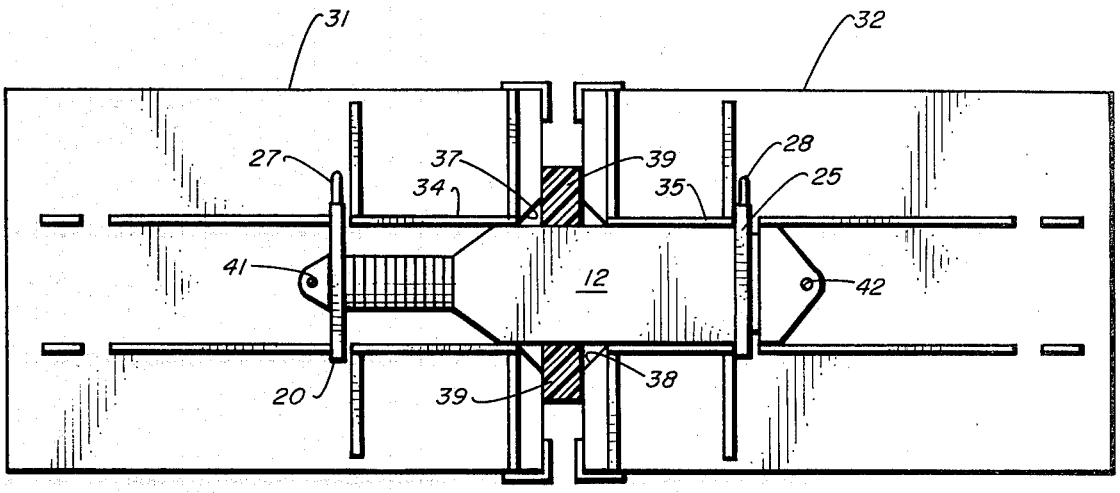
FIG. 3 shows two platforms connected together using the flexible side connector.
Figure 4:
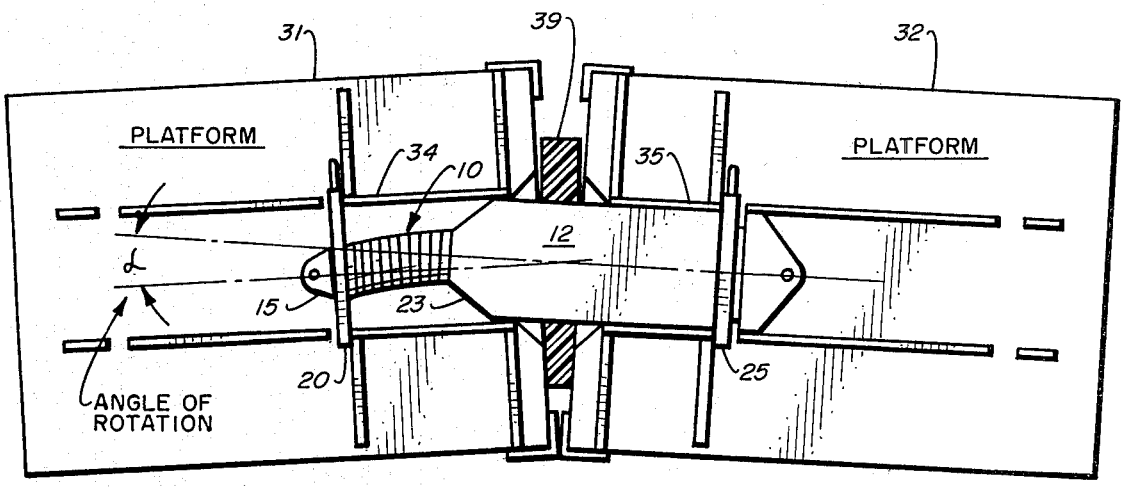
FIG. 4 illustrates rotation allowed between connected platforms by the flexible side connector.

The connector assembly is attached to each of two floating platform sections by means of the two guillotines 20 and 25 inserted in the grooved steel heads of members 10 and 12. The guillotines 20 and 25 bear on the slots shown in connector female assemblies 34 and 35, respectively, mounted in the platforms 31 and 32, as shown in FIG. 3. The female connector assemblies 34 and 35 are substantially the same and are bell shaped in cross section at 37 and 38, respectively, for ease of male connector installation in an open sea environment where relative motion between platform sections is prevelant. A buffer cushion 39 is normally provided between platforms as shown in FIGS. 3 and 4.

Functionally the side connector male assembly incorporates a padeye 41 on the solid steel head 15, and a padeye 42 on the end of shear member 12.

Figure 2:
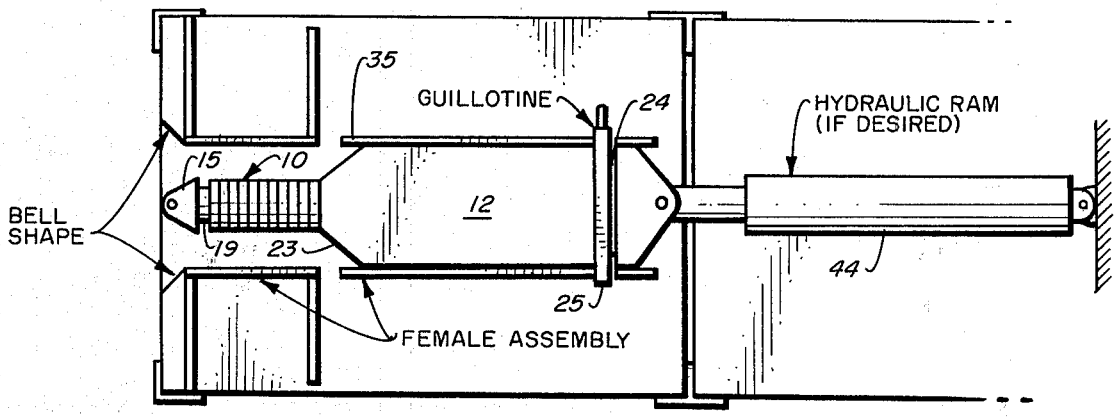
FIG. 2 shows a female assembly with a male assembly installed in one platform.

The padeyes are used to attach wire rope or any hydraulic cylinder 44, such as shown in FIG. 2, as required to pull or push the male connector assembly into position. The male connector assembly which is hydraulically or mechanically activated can be withdrawn into either platform to be connected, as shown in FIG. 2. The position after connecting two platforms together is shown in FIG. 3.

In operation, two flexible side connectors which have been previously installed in a platform (e.g., 32) are extended manually or hydraulically exposing the flexural rubber member 10. Only one flexible side connector is shown in FIG. 3; however, any number of such connectors can be used as desired; the single connector assembly illustrated is sufficient to show operation of the device.

Two platforms 31 and 32 are then brought into close proximity to one another using warping tugs and boats and a wire rope (not shown) is connected at 41 to each of the male assemblies and guided through the female connectors of the adjacent platform. The wire rope is attached to a warping tug winch or boat through block and tackle systems, etc., as required. As the wire rope is pulled, platforms 31 and 32 are drawn together and the flexural connector members 10 are pulled into the female receiver connectors 34 of the adjacent platform. The relative heave motion between the platforms is compensated for by the flexibility of the male flexural rubber assembly 10 and the bell shaped entrance 37 of female connector 34. The male assemblies when they have been extended are prevented from retracting into female connectors 35 by the guillotine stop plate 25. After the flexural members 10 are drawn into the female assemblies 34, guillotines 25 can be withdrawn and the male connectors fully extended from female assemblies 35 by hydraulic cylinders 44, for example, until the steel heads 15 can be locked into place in the female assemblies 34 with guillotines 20. Shear members 12 are then slightly withdrawn back into the female assemblies 35 drawing platforms 31 and 32 closer together, until shear members 12 can be locked in place with guillotines 25, as shown in FIG. 3 and buffer cushions 39 are snug against the platforms. The platforms are now securely locked together. FIG. 4 illustrates the flexing action of the flexible side connector.

The flexible side connectors can be dimensioned to meet the requirements for any size platform or ocean environment. The guillotine locking plates 20 and 25 and the solid steel heads can be made to self lock by using a sloped steel head surface and a prepositioned guillotine locking plate in the female connector. Also, the flexible side connector can be installed without the use of the wire rope using hydraulic cylinders only; the platforms 31 and 32 would be pushed together by tugs and boats as required.

Obviously, many modifications and variations of the present invention are possible in the light of the above teachings. It is therefore to be understood that within the scope of the appended claims the invention may be practiced otherwise than as specifically described.

What is claimed is:

1. A connector system for securing floating and elevated platforms together into a greater platform area while providing integrity and flexibility between platforms, comprising:

a. a first female tubular member normally mounted in the side of a first platform means which is to be connected to a second platform means;

b. a male flexural means comprising a large shear member having an outer diameter nearly equal to the inner diameter of said female tubular member and in-line flexural member of substantially smaller diameter than said shear member; said large shear member being operable to transmit vertical and lateral shear loads from one platform to another, and said smaller diameter in-line flexural member operable to allow relative rotation between platforms in the floating mode;

c. said male flexural means operable to slideably fit within said first female tubular member;

d. a first locking means in conjunction with said shear member for securing said male flexural means within said first female tubular member;

e. said in-line flexural member comprising compression means and a rigid metal head means articulately connected to one end of a tensile rod element to allow said rigid metal head a few degrees of angular movement at said connection to said tensile rod element; the opposite end of said tensile rod element being articulately connected to one end of said shear member to allow said rod a few degrees of angular movement at the connection to said shear member;

f. said in-line flexural member compression means including a plurality of rubber discs surrounding said tensile rod element between said rigid metal head and said one end of said shear member, said rubber discs bearing against said rigid metal head and against the said one end of said shear member;

g. said male flexural means also being operable to be partially extended from said first female tubular member such that said in-line flexural member and a portion of said shear member are extended sufficiently to be introduced into a second female tubular member which is mounted in an adjacent second platform means; said first and said second female tubular members being of substantially the same configuration and dimensions;

h. a second locking means in conjunction with said in-line flexural member for securing the extended portion of said male flexural means within said second female tubular member whereby said first and second platforms are connected together; said in-line flexural member being of substantially smaller diameter than the inner diameter of said second female tubular member to allow substantial flexing action of said in-line flexural member within said second female tubular member thereby permitting considerable relative roll motion between said first and said second connected together platform means while simultaneously said shear member provides a shear capability between the two platform means.

2. A device as in claim 1 wherein said tensile rod element is articulately connected to said shear member within a conical depression in one end of said shear member.

3. A device as in claim 1 wherein said tensile rod element is articulately connected to said rigid metal head means within a conical depression in said rigid metal head means.

4. A device as in claim 1 wherein said first locking means comprises a groove in the opposite end of said shear member for receiving a guillotine type locking mechanism which also is slideably mounted within a slot in said first female tubular member.

5. A device as in claim 1 wherein said first and said second female tubular members include means for securing either of said shear member and said in-line flexural member therewithin in any of a plurality of positions.

6. A device as in claim 1 wherein said second locking means comprises a groove in the rigid metal head means of said in-line flexural member for receiving a guillotine type locking mechanism which also is slideably mounted within a slot in said second female tubular member.

7. A device as in claim 1 wherein said first and said second female tubular members each have a bell-shaped entrance.

8. A device as in claim 1 wherein a compressible cushion means is provided between said first and second platforms about the entrance to said first and second female tubular members.

9. A device as in claim 1 wherein means is provided for extending and withdrawing said male flexural means from within said female tubular members.

10. A device as in claim 9 wherein said means for extending and withdrawing said male flexural means is an hydraulically operated device.

11. A device as in claim 1 wherein a padeye is provided at the end of said metal head on said in-line flexural member whereby a cable can be attached for mechanically pulling one end of said male flexural member extending from a first female tubular member on a first platform into a second female tubular member on a second platform.

12. A device as in claim 1 wherein a padeye is provided at the opposite end of said shear member for attaching said male flexural means to any of a cable and hydraulic equipment.

13. A device as in claim 1 wherein said first locking means is also operable to prevent said male flexural means when partially extended from said first female tubular member from retracting back into said first female tubular member.

14. A device as in claim 1 wherein a plurality of said first female tubular members and a respective plurality of male flexural means are provided on said first platform and operable to be connected to a respective plurality of second female tubular members on said second platform.

15. A device as in claim 1 wherein said shear member is beveled about the outer circumference of said one end thereof where adjacent to said in-line flexural member for ease in installation in said second female tubular member.

16. A device as in claim 1 wherein said shear member has sloping ends for ease in installation and a mid depth as required to transmit shear loads from said first platform to said second platform.

* * * * *